US005761632A

United States Patent [19]

Serizawa

[11] Patent Number: 5,761,632

[45] Date of Patent: Jun. 2, 1998

[54] VECTOR QUANTINIZER WITH DISTANCE MEASURE CALCULATED BY USING CORRELATIONS

[75] Inventor: Masahiro Serizawa, Tokyo, Japan

[73] Assignee: NEC Corporation, Tokyo, Japan

[21] Appl. No.: 857,653

[22] Filed: May 16, 1997

Related U.S. Application Data

[63] Continuation of Ser. No. 269,131, Jun. 30, 1994, abandoned.

[30] Foreign Application Priority Data

Jun. 30, 1993 [JP] Japan ..... 5-160554

[51] Int. Cl.[6] ..... G10L 3/02

[52] U.S. Cl. ..... 704/218; 704/216; 704/217; 704/222; 704/219; 704/220

[58] Field of Search ..... 704/216–222

[56] References Cited

U.S. PATENT DOCUMENTS

| | | | |
|---|---|---|---|
| 4,612,414 | 9/1986 | Juang | 380/43 |
| 4,868,867 | 9/1989 | Davidson et al. | 395/2.39 |
| 5,142,584 | 8/1992 | Ozawa | 395/2.32 |
| 5,173,941 | 12/1992 | Yip et al. | 395/2.26 |
| 5,179,594 | 1/1993 | Yip et al. | 395/2.26 |
| 5,187,745 | 2/1993 | Yip et al. | 395/2.28 |
| 5,208,862 | 5/1993 | Ozawa | 395/2.25 |
| 5,265,190 | 11/1993 | Yip et al. | 395/2.28 |
| 5,323,486 | 6/1994 | Taniguchi et al. | 395/2.31 |
| 5,485,581 | 1/1996 | Miyano et al. | 395/2.32 |

FOREIGN PATENT DOCUMENTS

| | | | |
|---|---|---|---|
| 0 545 386 | 6/1993 | European Pat. Off. . | |
| 0 557 940 | 9/1993 | European Pat. Off. . | |
| 5-232997 | 10/1993 | Japan | 295/2.31 |

OTHER PUBLICATIONS

Trancoso and Atal, "Efficient Search Procedures for Selecting the Optimum Innovation in Stochastic Coders", IEEE Transactions on Acoustics, Speech and Signal Processing, vol. 38, No. 3, Mar. 1990, pp. 385–395.

Ozawa and Miyano, "4kb/s Improved Celp Coder with Efficient Vector Quantization", Proceedings of ICASSP, S4.4, 1991, pp. 214–216.

M. Schroeder and B. Atal, –"Code–Excited Linear Prediction (CELP): High–Quality Speech At Very Low Bit Rates" IEEE Proc. ICASSP–85, pp. 937–940, 1985.

L.R. Labiner and R.W. Schafer, "Digital Processing of Speech" Section 8.1, pp. 396–405.

K. Paliwal and B. Atal, Efficient Vector Quantization of LPC Parameters at 24 Bits/ Frame IEEE Transactions on Speech and Audio Processing, vol. 1, No. 1, Jan. 1993.

*Primary Examiner*—Allen R. MacDonald
*Assistant Examiner*—Michael N. Opsasnick
*Attorney, Agent, or Firm*—Foley & Lardner

[57] ABSTRACT

A vector quantizer for a speech coder for coding speech signals at low bit rates. The vector quantizer includes an auto-correlation calculation circuit for calculating an impulse response of a weighting function for each sub-interval of an input signal vector. The vector quantizer also includes a weighted cross-correlation calculation circuit for calculating a weighted cross-correlation of the weighted input signal vector and the weighted codevector having a code length equal to that of the input signal vector. The vector quantizer further includes a weighted auto-correlation calculation circuit for calculating an auto-correlation of the weighted codevectors, by using respective auto-correlations of the impulse responses, the codevectors and the cross-correlations. A distance between the input signal vector and the codevector is calculated by using the cross-correlations of the weighted input signal vector and the weighted codevectors, and the auto-correlation of the weighted codevector, and an index of a codevector corresponding to the minimum distance is obtained by an inspection circuit.

5 Claims, 4 Drawing Sheets

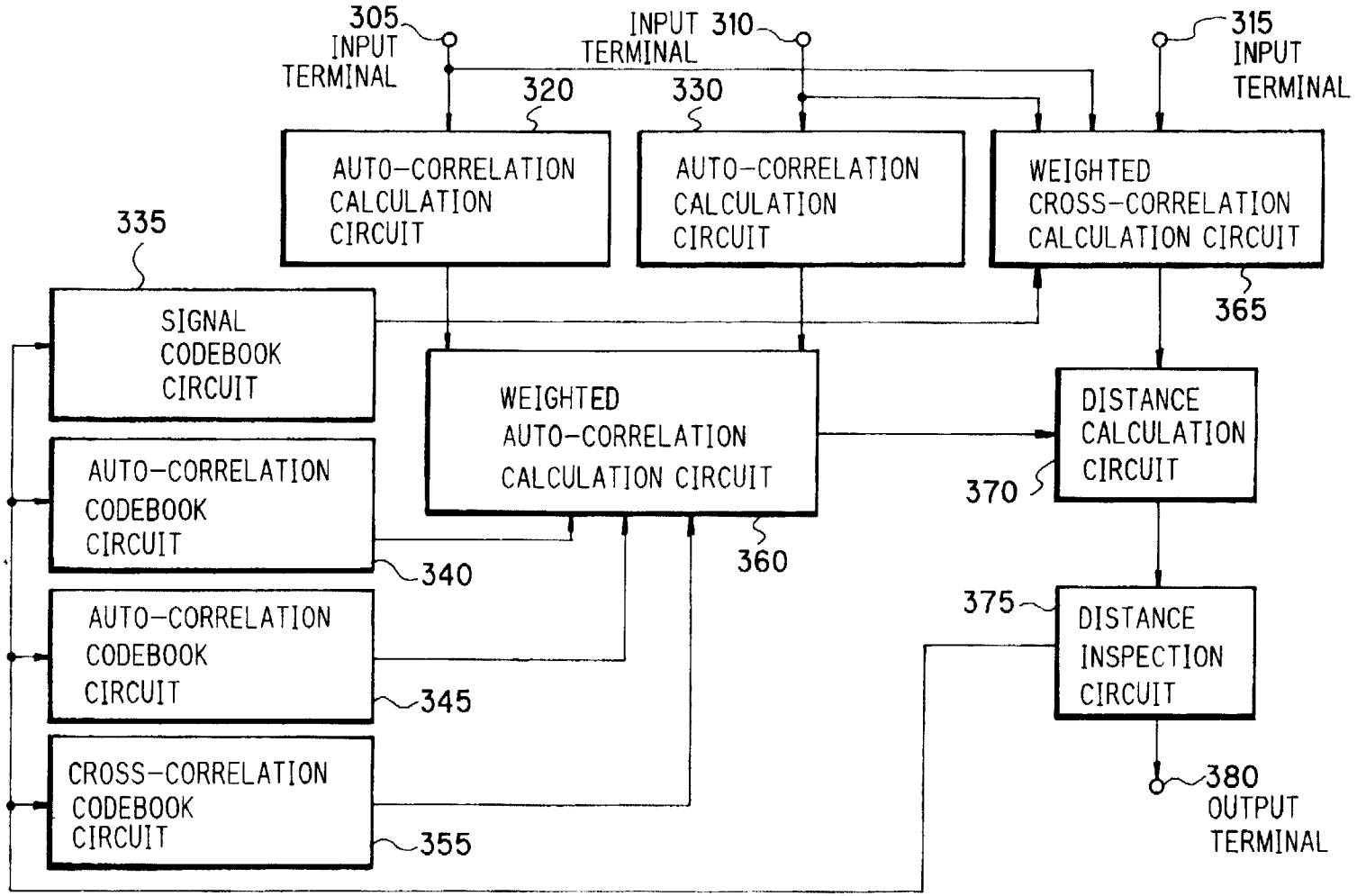
FIG. 1
315 INPUT TERMINAL
WEIGHTED CROSS-CORRELATION CALCULATION CIRCUIT
365
DISTANCE CALCULATION CIRCUIT
370
DISTANCE INSPECTION CIRCUIT
375
380 OUTPUT TERMINAL
INPUT 310 TERMINAL
330
AUTO-CORRELATION CALCULATION CIRCUIT
WEIGHTED AUTO-CORRELATION CALCULATION CIRCUIT
360
320
AUTO-CORRELATION CALCULATION CIRCUIT
305 INPUT TERMINAL
335
SIGNAL CODEBOOK CIRCUIT
AUTO-CORRELATION CODEBOOK CIRCUIT
340
AUTO-CORRELATION CODEBOOK CIRCUIT
345
CROSS-CORRELATION CODEBOOK CIRCUIT
355

VECTOR QUANTINIZER WITH DISTANCE MEASURE CALCULATED BY USING CORRELATIONS

This application is a continuation of application Ser. No. 08/269,131, filed Jun. 30, 1994, now abandoned.

BACKGROUND OF THE INVENTION

1. Field of the Invention

The present invention relates to a vector quantizer and, more particularly, to a vector quantizer for a speech coder for coding speech signals with a high quality at low bit rates, particularly 4 kb/s or less.

2. Description of the Related Art

A CELP (code excited linear prediction) system is well known in the art as a system effective for low bit rate coding speech signals. In the CELP system, a speech signal is analyzed on the basis of a linear prediction, and the resultant residual signal is vector quantized. In an application of the CELP system to coding at a bit rate 4 kb/s or less, bits that can be allocated for the residual signal are insufficient, and therefore it is necessary to increase the vector length. This leads to a problem that the quantization of changes in the speech characteristic in the vector is insufficient. To solve this problem, a vector quantizer has been proposed, in which changes in the speech characteristic in the vector are considered, as disclosed in Tokugan Hei 4-35881 issued by Japanese Patent Office, entitled "Speech Coding Apparatus". In this prior art system, denoting an input signal vector by $\vec{\chi} \leftrightarrows [x(0), x(1), \ldots, x(N-1)]$, a codevector for quantizing the input signal vector by $\vec{c}(i)=[c(i, 0), c(i, 1), \ldots, c(i, N-1)]$, (i being the codevector index number, S being a codebook size and 1=0, 1, . . . , S−1), the gain by g(i) and the weighting function matrix by W, the quantization is made by searching for an index, with which the weighting squared distance D(i) in the equation below is minimum.

$$D(i)=(\vec{\chi}-g(i)\vec{c}(i))^T\vec{W}^T\vec{W}(\vec{\chi}-g(i)\vec{c}(i)) \quad (1)$$

In this case, the optimum value of g(i), with which the equation (1) assumes a minimum value, is $$g^{opt}(i)=\vec{\chi}^T\vec{W}^T\vec{W}\vec{c}(i)/\vec{\chi}^T\vec{W}^T\vec{W}\vec{\chi} \quad (2)$$

By substituting the equation (1) into the equation (2), $$D^{opt}(i)=\vec{\chi}^T\vec{W}^T\vec{W}\vec{\chi}-(\vec{\chi}^T\vec{W}^T\vec{W}\vec{c}(i))^2/\vec{c}(i)^T\vec{W}^T\vec{W}\vec{c}(i) \quad (3)$$

where T means the transpose conversion of matrix and vector.

The weighting function matrix $\vec{W}$ is for a distinct weighting in each divided sub-interval (hereinafter referred as sub-interval) in the input signal vector $\vec{\chi}$. An example will now be considered, in which the number of sub-intervals is 2, and the weighting is made on an input signal x(0), . . . , x(N(0)−1) with an impulse response h(0, i) (i=0, 1, . . . ,L−1) and on an input signal x(N(0)), . . . , x(N−1) with an impulse response h(1, i) (i=0, 1, . . . , L−1). The weighting function matrix $\vec{W}$ is given as impulse response matrices shown by equations (4) to (7).

$$\vec{W}=\begin{bmatrix} \vec{W}(0) & \vec{0} \\ \vec{W}1(1) & \vec{W}(1) \\ \vec{0} & \vec{W}1(1) \end{bmatrix} \quad (4)$$

$$\vec{W}(0)=\begin{bmatrix} h(0,0) & 0 & \ldots & & & 0 \\ h(0,1) & h(0,0) & & & & \\ \vdots & & & & & \vdots \\ h(0,L-1) & & & & & \\ 0 & & & & & \\ \vdots & & & & & 0 \\ 0 & \ldots & 0 & h(0,L-1) & \ldots & h(0,0) \end{bmatrix} \quad (5)$$

$$\vec{W}(1)=\begin{bmatrix} h(1,0) & 0 & \ldots & & & 0 \\ h(1,1) & h(1,0) & & & & \\ \vdots & & & & & \vdots \\ h(1,L-1) & & & & & \\ 0 & & & & & \\ \vdots & & & & & 0 \\ 0 & \ldots & 0 & h(1,L-1) & \ldots & h(1,0) \end{bmatrix} \quad (6)$$

$$\vec{W}1(1)=\begin{bmatrix} 0 & \ldots & 0 & h(1,L-1) & \ldots & h(1,1) \\ & & & & & \vdots \\ \vdots & & & & & h(1,L-1) \\ & & & & & 0 \\ & & & & & \vdots \\ 0 & \ldots & & & & 0 \end{bmatrix} \quad (7)$$

The first term $\vec{\chi}^T\vec{W}^T\vec{W}\vec{\chi}$ on the right-hand side of the equation (3) is not based on any codevector but is constant, so that it need not be calculated for each index. Thus, the measure of the distance for the search is $$E^{opt}(i)=-(\vec{\chi}^T\vec{W}^T\vec{W}\vec{c}(i))^2/\vec{c}(i)^T\vec{W}^T\vec{W}\vec{c}(i) \quad (8)$$

The above prior art will now be described with reference to the drawings.

FIG. 3 is a block diagram showing a prior art vector quantizer. Referring to the FIG. 3, from input terminals 115, 105 and 110 are supplied, respectively, an input signal vector, an impulse response for weighting of a first sub-interval, and an impulse response for weighting of a second sub-interval. A weighting circuit 117 weights the $\vec{W}\vec{\chi}$. Another weighting circuit 125 weights $\vec{W}\vec{c}(i)$ with respect to each codevector $c\vec{c}(i)$. A weighted auto-correlation calculation circuit 130 calculates the auto-correlation of $\vec{\chi}^T\vec{W}^T\vec{W}\vec{\chi}$. A weighted cross-correlation calculation circuit 135 calculates $\vec{\chi}^T\vec{W}^T\vec{W}\vec{c}(i)$ with respect to each codevector $\vec{c}(i)$. A distance calculation circuit 140 calculates the distance $E^{opt}(i)$ by using the equation (8). A distance determination circuit 145 supplies a quantization index of a codevector corresponding to minimum $E^{opt}(i)$.

In this prior art vector quantizer, the efficiency of quantization can be improved by making weighting for each sub-interval in the input signal vector.

In this prior art vector quantizer, the amount of operations that is required for quantizing a single input signal vector for each circuit is L(2N–L+1)/2 operations in the weighting circuit and in the signal codebook circuit, L(2N–L+1)/2 operations in the input signal weighting circuit, SN operations in the weighting signal auto-correlation calculation circuit, SN operations in the weighting signal cross-correlation calculation circuit, 2S operations in the distance calculation circuit and the distance inspection circuit, i.e., a total of L(2N–L+1)/2+S[L(2N–L+1)/2+N+2] times. Here, the product summation, the addition and the subtraction are counted as one operation, respectively.

As a specific example of the amount of operations, assuming that N=80, N(0)=40, L=21 and S=256, the amount of operations necessary for quantizing an input signal vector is 419,262 operations. In the prior art vector quantizer, since the weighting calculation has to be done with each codevector as noted above, the amount of operations required is enormous.

SUMMARY OF THE INVENTION

An object of the present invention is, therefore, to solve the above problem and permit vector quantization with a small amount of operations.

According to one aspect of the present invention, there is provided a vector quantizer. The vector quantizer includes: plurality of auto-correlation calculation means each of which calculates an auto-correlation of an impulse response signal of a weighting function for the corresponding sub-interval of a plurality of sub-intervals of an input signal vector. The vector quantizer also includes a signal codebook means for storing a plurality of codevectors produced in advance, each of the codevectors having a length equal to a code length of the input signal vector. The vector quantizer further includes a plurality of auto-correlation codebook means for storing the plurality of auto-correlations calculated by the auto-correlation calculation means. The vector quantizer still further includes a plurality of cross-correlation codebook means for storing a plurality of cross-correlation of the respective sub-intervals of the codevector. The vector quantizer also includes a weighted cross-correlation calculation means for calculating a weighted cross-correlation of the weighted input signal vector and the weighted codevectors, by using the input signal vector, the plurality of codevectors and the plurality of impulse responses. The vector quantizer further includes a weighted auto-correlation calculation means for calculating an auto-correlation of the weighted codevectors, by using the auto-correlations of the plurality of impulse responses, of the plurality of codevectors and of the cross-correlations. The vector quantizer still further includes a distance calculation means for calculating a distance between the input vector and the codevector, by using the cross-correlations of the weighted input signal vector and weighted codevectors, and the auto-correlation of the weighted codevector. The vector quantizer also includes a distance inspection means for supplying an index of a codevector corresponding to the minimum distance.

According to another aspect of the present invention, there is provided a vector quantizer. The vector quantizer includes a plurality of auto-correlation calculation means each of which calculates an auto-correlation of an impulse response signal of a weighting function for the corresponding sub-interval of a plurality of sub-intervals of an input signal vector. The vector quantizer also includes a signal codebook means for storing a plurality of codevectors produced in advance, each of the codevectors having a length equal to a code length of the input signal vector. The vector quantizer further includes a plurality of auto-correlation codebook means for storing the plurality of auto-correlations calculated by the auto-correlation calculation means. The vector quantizer still further includes a plurality of cross-correlation codebook means for storing a plurality of cross-correlation of the respective sub-intervals of the codevector. The vector quantizer also includes a weighted cross-correlation calculation means for calculating a weighted cross-correlation of the weighted input signal vector and the weighted codevectors, by using the input signal vector, the plurality of codevectors and the plurality of impulse responses. The vector quantizer further includes a weighted auto-correlation calculation means for calculating an auto-correlation of the weighted codevectors, by using the auto-correlations of the plurality of impulse responses, and of the plurality of codevectors. The vector quantizer still further includes a distance calculation means for calculating a distance between the input vector and the codevector, by using the cross-correlations of the weighted input signal vector and weighted codevectors, and the auto-correlation of the weighted codevector. The vector quantizer also includes a distance inspection means for supplying an index of a codevector corresponding to the minimum distance.

Other objects and features of the present invention will be clarified from the following description with reference to attached drawings.

BRIEF DESCRIPTION OF THE DRAWINGS

FIG. 1 is a block diagram showing a first embodiment of the present invention;

DETAILED DESCRIPTION OF THE PREFERRED EMBODIMENTS

Figure 2A:
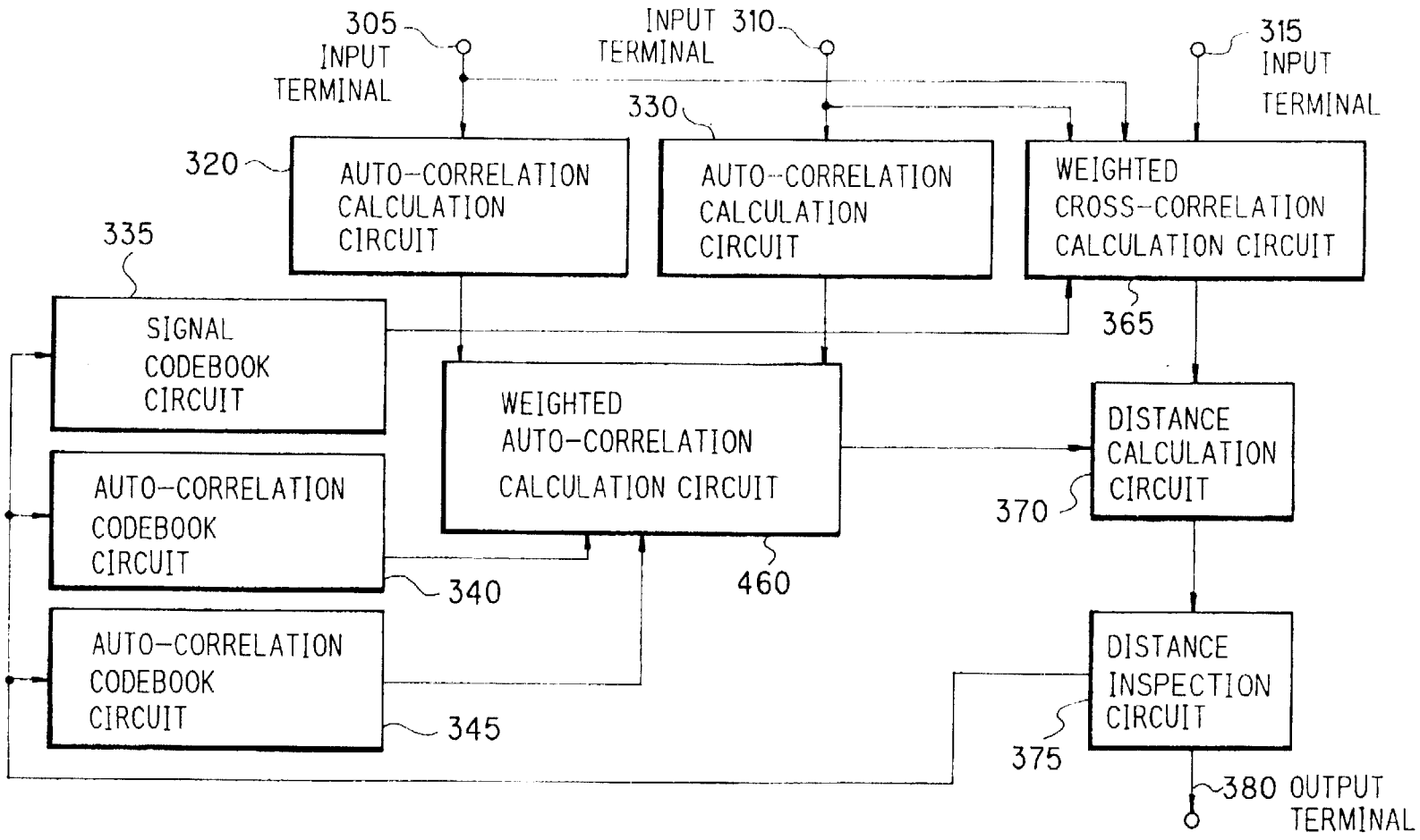
FIGS. 2A, 2B is a block diagram showing the second embodiment of the present invention.

In the vector quantizer according to the present invention, when the change in the weighting function (i.e., impulse response) for a sub-interval is small, an approximation can be introduced into the calculation of $\vec{c}(i)^T\vec{W}^T\vec{W}\vec{c}(i)$ in the prior art vector quantizer, thus permitting the reduction of the amount of operations.

To derive the approximate equation, the following definition is made.

$$\vec{c}(i) = \begin{bmatrix} \vec{c0}(i) \\ \vec{c1}(i) \end{bmatrix} \tag{9}$$

$$\vec{c}0(i) = [c(i,0), c(i,1), \ldots, c(i,N(0)-1)]$$

$$\vec{c}1(i) = [c(i,N(0)), c(i,N(0)+1), \ldots, c(i,N-1)]$$

To avoid the complexity in the following expansion, the factor (i) representing an index of $\vec{c0}(i)$ and $\vec{c1}(i)$ is omitted. At this time, by using the equations (9) and (4), $\vec{c}(i)^T\vec{W}^T\vec{W}\vec{c}(i)$ can be expanded as follows.

$$\begin{aligned} \vec{c}(i)^T\vec{W}^T\vec{W}\vec{c}(i) = {} & \vec{c0}^T\vec{W}(0)^T\vec{W}(0)\vec{c0} + \\ & \vec{c0}^T\vec{W}1(1)^T\vec{W}1(1)\vec{c0} + \\ & \vec{c1}^T\vec{W}(1)^T\vec{W}(1)\vec{c1} + \\ & \vec{c1}^T\vec{W}1(1)^T\vec{W}1(1)\vec{c1} + \\ & 2\vec{c0}^T\vec{W}1(1)^T\vec{W}(1)\vec{c1} \end{aligned} \tag{10}$$

Now, the approximate calculation of each term on the right-hand side will be explained.

The calculation of the first and second terms $\vec{c0}^T\vec{W}(0)^T\vec{W}(0)\vec{c0}+\vec{c0}^T\vec{W}1(1)^T\vec{W}1(1)\vec{c0}$ in the equation (10) will be described. Since the difference between the weighting functions (impulse responses) of the first and second sub-intervals is small and the second term as a component of the influence signal in the first term is small, an approximation can be given as (1st term)+(2nd term)

$$\cong \vec{c0}^T\vec{W}(0)^T\vec{W}(0)\vec{c0}+\vec{c0}^T\vec{W}0(0)^T\vec{W}0(0)\vec{c0} \tag{11}$$

Further, by using an auto-correlation approach described in a treatise by I. M. Trancoso and B. S. Atal and entitled "Efficient Search Procedures for Selecting the Optimum Innovation in Stochastic Coders" IEEE Transactions on Acoustics, Speech, and Signal Processing., Vol. 38, No. 3, March 1990, the approximation can be done as follows:

$$\text{(1st term)} + \text{(2nd term)} = \tag{12}$$

$$= \vec{c0}^T \begin{bmatrix} H(0,0) & H(0,1) & \ldots & H(0,L-1) & 0 & \ldots & 0 \\ H(0,1) & & & & & & \\ \vdots & & & & & & \\ H(0,L-1) & & & & & & H(0,L-1) \\ 0 & & & & & & \vdots \\ \vdots & & & & & & \\ 0 & \ldots & 0 & H(0,L-1) & \ldots & & H(0,0) \end{bmatrix} \vec{c0} \tag{13}$$

$$= \sum_{j=0}^{N(0)-1} \sum_{k=0}^{N(0)-1} c(0,j)c(0,k)H(0,j-k) \tag{14}$$

where H(O,j) is the auto-correlation of the impulse response calculated as $$H(0,j) = \begin{cases} \sum_{k=0}^{L-1-j} h(0,k)h(0,k+j) & (j=0,1,\ldots,L-1) \\ 0 & (j=L,\ldots,N(0)-1) \end{cases} \tag{15}$$

Further, by using the auto-correlation of the first sub-section of the codevector, $$C(0,i) = \sum_{j=0}^{N(0)-1-i} c(0,j)c(0,j+i) \tag{16}$$

Thus, we can obtain an approximate equation for the first and second terms in the equation (10) as $$= C(0,0)H(0,0) + 2\sum_{j=1}^{L-1} C(0,j)H(0,j) \tag{17}$$

The third and fourth terms:

$$\vec{c1}^T\vec{W}(1)^T\vec{W}(1)\vec{c1}+\vec{c1}^T\vec{W1}(1)^T\vec{W}1(1)\vec{c1}$$

are calculated by using the auto-correlation approach as noted above and setting the auto-correlation function H(1,j) and the auto-correlation C(1,j) of the weighting impulse response for the second sub-interval as $$H(1,j) = \begin{cases} \sum_{k=0}^{L-1-j} h(1,k)h(1,k+j) & (j = N(0), \ldots, N(0)+L-1) \\ 0 & (j = N(0)+L, \ldots, N-1) \end{cases} \quad (18)$$

$$C(1,j) = \sum_{k=0}^{N-N(0)-1-j} c(1,k)c(1,k+j) \quad (19)$$

The calculation is made by using the above auto-correlation approach as follows:

$$\text{(the 3rd term)} + \text{(the 4th term)} = \quad (20)$$

$$= \vec{c1}^T \begin{bmatrix} H(1,0) & H(1,1) & \ldots & H(1,L-1) & 0 & \ldots & 0 \\ H(1,1) & & & & & & \\ \vdots & & & & & & \\ H(1,L-1) & & & & & & H(1,L-1) \\ 0 & & & & & & \vdots \\ \vdots & & & & & & \\ 0 & \ldots & 0 & H(1,L-1) & \ldots & & H(1,0) \end{bmatrix} \vec{c1} \quad (21)$$

$$= \sum_{j=0}^{N-N(0)-1} \sum_{k=0}^{N-N(0)-1} c(1,j)c(1,k)H(1,j-k) \quad (22)$$

$$= C(1,0)H(1,0) + 2\sum_{i=1}^{L-1} C(1,i)H(1,i) \quad (23)$$

The calculation of the fifth term $2\vec{c0}^T\vec{W}1(1)^T\vec{W}(1)\vec{c1}$ can be transformed and calculated as:

$$(5th \text{ term}) = \quad (24)$$

$$= 2\vec{c0}^T \begin{bmatrix} 0 & \ldots & 0 \\ \vdots & & 0 \\ 0 & & 0 \\ H(1,L-1) & & \vdots \\ \vdots & & \\ H(1,1) & \ldots H(1,L-1) \; 0 \; \ldots & 0 \end{bmatrix} \vec{c1} \quad (25)$$

$$= 2\sum_{i=0}^{L-2} C1(1,i)H(1,(L-1)-i)$$

where C1(1,i) is the cross-correlation between the first and second sub-intervals of the codevector calculated as $$C1(1,j) = \sum_{k=0}^{L-2-j} c(0,N(0)-L+1+j+k)c(1,k) \quad (26)$$

Thus, with the auto-correlation and cross-correlation of the individual sub-intervals of the codevector calculated in advance and stored as a correlation codebook, the approximation to $\vec{c}(i)^T\vec{W}^T\vec{W}\vec{c}(i)$ can be calculated by using the equations (17), (23), (25) and (10).

Meanwhile, $\vec{c}(i)^T\vec{W}^T\vec{W}\vec{\chi}$ is calculated by using a method described in Miyano & Ozawa "4 kb/s Improved CELP Coder with Efficient Vector Quantization", Proceedings of ICASSP, S4.4 pp. 214–216, 1991. More specifically, it is not that the input signal vector and the codevector are each weighted as in the middle side of the equation (27), but the weighting input vector $\vec{W}\vec{\chi}$ is first multiplied by the transpose matrix $\vec{W}^T$ of the weighting function matrix as in the right-hand side of the equation (27). Thus, it is possible to obtain $\vec{c}(i)^T\vec{W}^T\vec{W}\vec{\chi}$ with the sole inner product calculation on $\vec{c}(i)$ and $\vec{W}^T\vec{W}\vec{\chi}$.

$$\vec{c}(i)^T\vec{W}^T\vec{W}\vec{\chi} = \vec{c}(i)^T(\vec{W}^T\vec{W}\vec{\chi}) \quad (27)$$

Thus, there is no need of carrying out the weighting calculation on $\vec{W}\vec{c}(i)$ for each codevector, and the amount of operations can be reduced.

The amount of operations necessary for quantizing an input signal vector is L(L+1)/2 operations for the auto-correlation calculation of the input weighting function 1 (impulse response 1), L(L+1)/2 times of the calculation of the auto-correlation of the input weighting function 2(impulse response 2), S(3L−1) operations for the auto-correlation calculation of the weighting signal, L(2N−L+1)/2+SN operations for the cross-correlation calculation of the weighting signal, 2S operations for the distance calculation and the distance inspection circuits, i.e., a total of L(L+1)+L(2N−L+1)/2+S(3L−1+N+2) operations. Under the condition noted above, the amount of operations is 38,796 operations. This amount is as small as about one-tenth of the amount necessary in the prior art process. However, it is thought that performance deterioration arises from the use of the approximation.

Further, according to the present invention in the calculation with the equation (10), the third and fourth terms for calculating the component in the first sub-interval that has influence on the second sub-interval are omitted. Consequently, the accuracy of approximation is reduced to result in some deterioration of the quantization performance. However, the amount of operations can be further reduced. Specifically, the total amount of operations is 2L(L+1)/2+L(2N−L+1)/2+S[2L+N+2] times, and under the above condition it is 35,146 operations.

As has been shown, by using the vector quantizer according to the present invention it is possible to obtain vector quantization with a very small amount of operations compared with that of the prior art vector quantizer.

DETAILED DESCRIPTION OF THE PREFERRED EMBODIMENTS

The present invention will now be described with reference to the drawings.

FIG. 1 is a block diagram showing a first embodiment of the present invention.

Referring to FIG. 1, there is shown a first embodiment of the vector quantizer according to the present invention. The illustrated vector quantizer comprises auto-correlation calculation circuits 320 and 330, which respectively receive at their input terminals 305 and 310 the first and second impulse response signals of weighting functions with respect to predetermined first and second sub-intervals of an input signal vector input from an input terminal 315 and calculate first and second auto-correlations of the first and second impulse response signals. The vector quantizer also includes a signal codebook circuit 335, in which a plurality of codevectors produced in advance and having a length equal to the code length of the input signal vector is stored. The vector quantizer further includes an auto-correlation codebook circuit 340, in which the first auto-correlation of the first sub-interval of the codevector is stored, a auto-correlation codebook circuit 345, in which the second auto-correlation of the second sub-interval of the codevector is stored, and a cross-correlation codebook circuit 355, in which the cross-correlation between the first and second sub-intervals of the codevector is stored. The vector quantizer still further includes a weighted cross-correlation calculation circuit 365 for calculating the weighted cross-correlation between the weighted input signal and the codevector of which the first and second sub-intervals are weighted by using the first and second impulse responses, and a weighted auto-correlation function calculation circuit 360 for calculating the weighted auto-correlation function of the weighted codevector by using the auto-correlations of the first and second impulse responses, the first and second auto-correlations of the first and second sub-intervals of the codevector and the cross-correlation between the first and second sub-intervals. The vector quantizer also includes a distance calculation circuit 370 for calculating distance by using the weighted cross-correlation between the weighted input signal and weighted codevectors and the weighted auto-correlation of the weighted codevector, and a distance inspection circuit 375 for supplying an index of a codevector corresponding to the minimum distance.

The operation of the first embodiment will now be described with reference to FIG. 1. The equations (8) to (27) are used for the description.

The signal codebook circuit 335, in which a plurality of vectors produced in advance and having a length equal to the code length of the input signal code is stored, supplies codevectors in the order of indexes to the weighted cross-correlation calculation circuit 365 whenever it receives an output command flag from the distance inspection circuit 375. The auto-correlation codebook circuit 340, in which the first auto-correlation calculated in advance by using the equation (16) is stored, supplies the first auto-correlation in the order of indexes to the weighted auto-correlation calculation circuit 360 whenever it receives an output command flag from the distance inspection circuit 375.

The auto-correlation codebook circuit 345, in which the second auto-correlation calculated in advance by using the equation (19) is stored, supplies the second auto-correlation in the order of indexes to the weighted auto-correlation calculation circuit 360 whenever it receives an output command flag from the distance inspection circuit 375. The cross-correlation codebook circuit 355, in which the cross-correlation calculated in advance by using the equation (26) is stored, supplies the cross-correlation in the order of indexes to the weighted auto-correlation calculation circuit 360 whenever it receives an output command flag from the distance inspection circuit 375.

The auto-correlation calculation circuit 320 calculates the auto-correlation of the first impulse response input from the input terminal 305 by using the equation (15) and delivers the calculated auto-correlation to the weighted auto-correlation calculation circuit 360.

The auto-correlation calculation circuit 330 calculates the auto-correlation of the second impulse response input from the input terminal 310 by using the equation (10) and delivers the calculated auto-correlation to the weighted auto-correlation calculation circuit 360. The weighted cross-correlation calculation circuit 365 calculates $\vec{W}^T\vec{W}\vec{\chi}$ in the equation (27) by using the input signal vector $\vec{\chi}$ input from the input terminal 315 and the first and second impulse responses input from the input terminals 305 and 310. Then, it receives the codevector $\vec{c}(i)$ from the signal codebook circuit 335 and calculates the cross-correlation $\vec{c}(i)^T\vec{W}^T\vec{W}\vec{\chi}$ from the weighted input signal vector and the weighted codevector. Finally, it delivers the calculated cross-correlation $\vec{c}(i)^T\vec{W}^T\vec{W}\vec{\chi}$ to the distance calculation circuit 370.

The weighted auto-correlation calculation circuit 360 receives the first and second auto-correlations in the equation (16) and (19) and the cross-correlation in the equation (26) from the auto-correlation codebook circuits 340 and 345 and the cross-correlation codebook circuit 355, respectively, calculates the auto-correlation of the weighted codevector with the equations (17), (23), (25) and (10), and delivers the calculated auto-correlation to the distance calculation circuit 370.

The distance calculation circuit 370 calculates the distance from the auto-correlation of the weighted codevector calculated in the weighted auto-correlation calculation circuit 360 and the cross-correlation of the weighted codevector and the weighted input signal vector calculated in the weighted cross-correlation calculation circuit 365 by using the equation (8). The distance inspection circuit 375 delivers the index of the codevector corresponding to the minimum calculated distance to the output terminal 380. Then, it supplies output command flags to the signal codebook circuit 335, the first and second auto-correlation codebook circuits 340 and 345 and the cross-correlation codebook circuit 355, such that these circuits supply the next codevector, auto-correlations and cross-correlation.

Figure 2B:
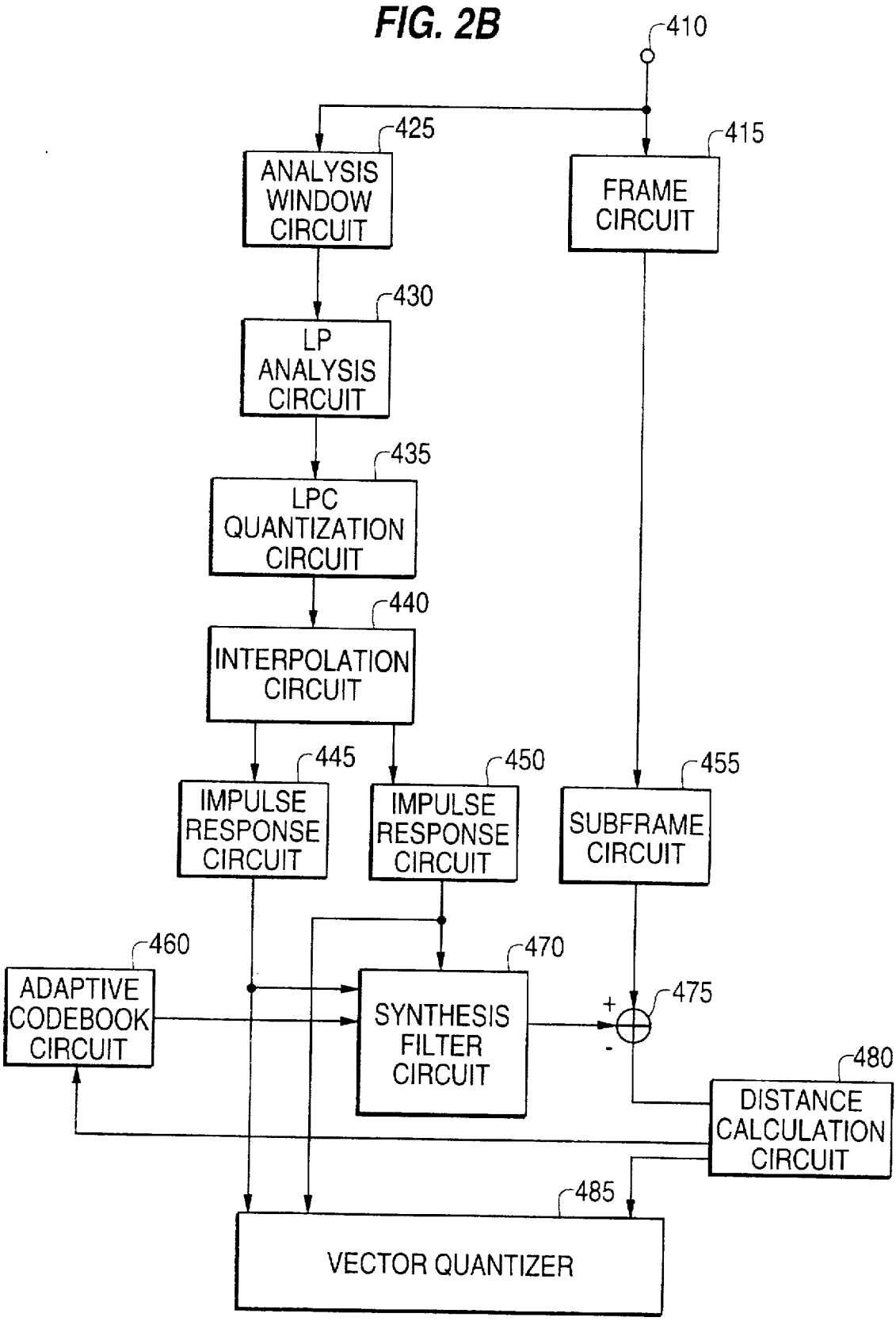
Figure 3:
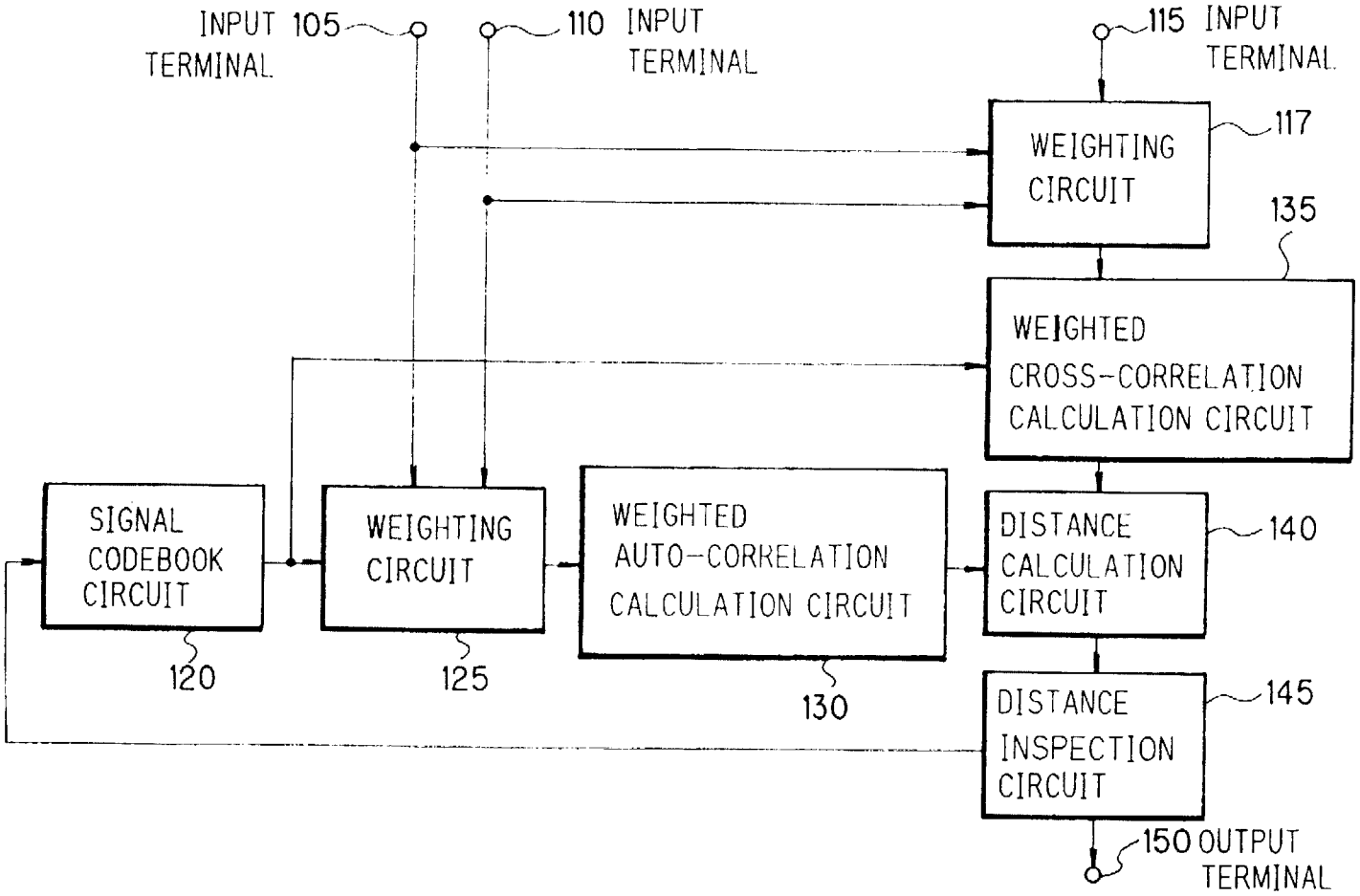
FIG. 3 (PRIOR ART)
FIG. 3 is a block diagram showing a prior art vector quantizer.

Now, a second embodiment of the present invention will be described. FIG. 2A, 2B is a block diagram showing the second embodiment of the present invention. FIG. 2B is a utilization of the second embodiment as CELP speech coder.

In FIG. 2, parts like those in the first embodiment shown in FIG. 1 are designated by like reference numerals and symbols. This second embodiment is different from the first embodiment in that it comprises a weighted auto-correlation calculation circuit 460 which is provided in lieu of the weighted auto-correlation calculation circuit 360. The weighted auto-correlation calculation circuit 460 has a function of calculating the auto-correlation of the weighted codevector by using the auto-correlations of the first and second impulse responses and the first and second auto-correlations of the first and second sub-intervals of the codevector. The cross-correlation codebook circuit 355 is omitted.

The operation of the second embodiment will now be described with reference to FIG. 2 and by using the equations (8) to (27).

The signal codebook circuit 335, in which a plurality of vectors produced in advance and having the same length as the code length of the input signal vector is stored, supplies the codevector in the order of indexes to the weighted cross-correlation calculation circuit 365 when it receives an output command flag from the distance inspection circuit 375. The auto-correlation codebook circuit 340, in which the first auto-correlation calculated in advance by using the equation (16) is stored, supplies the first auto-correlation in the order of indexes to the weighted auto-correlation calculation circuit 460 when it receives an output command flag from the distance inspection circuit 375.

The auto-correlation codebook circuit 345, in which the second auto-correlation calculated in advance by using the equation (19) is stored, supplies the second auto-correlation in the order of indexes to the weighted auto-correlation calculation circuit 460 when it receives an output command flag from the distance inspection circuit 375.

The auto-correlation calculation circuit 320 calculates the auto-correlation of the first impulse response input from the input terminal 305 by using the equation (15) and delivers the calculated auto-correlation to the weighted auto-correlation calculation circuit 460.

The auto-correlation calculation circuit 330 calculates the auto-correlation of the second impulse response input from the input terminal 310 by using the equation (18) and delivers the calculated auto-correlation to the weighted auto-correlation calculation circuit 460. The weighted cross-correlation calculation circuit 365 first calculates $\vec{W}^T\vec{W}\vec{\chi}$ in the equation (27) by using the input signal vector $\vec{\chi}$ input from the input terminal 315 and the first and second impulse responses input from the input terminals 305 and 310.

Then, it receives the codevector $\vec{c}(i)$ from the signal codebook circuit 335, and calculates the cross-correlation $\vec{c}(i)^T\vec{W}^T\vec{W}\vec{\chi}$ of the weighted input signal vector and the weighted codevector. Finally, it delivers the calculated cross-correlation $\vec{c}(i)^T\vec{W}^T\vec{W}\vec{\chi}$ to the distance calculation circuit 370. The weighted signal auto-correlation calculation circuit 460 receives the auto-correlations in the equations (16) and (19) from the auto-correlation codebook circuits 340 and 345, and calculates the auto-correlation of the weighted codevector by using the equations (17) and (23) and an equation, which is obtained from the equation (10) by deleting the fifth term $2c\vec{0}^T\vec{W}1(1)^T\vec{W}(1)c\vec{1}$, and delivers the calculated auto-correlation to the distance calculation circuit 370.

The distance calculation circuit 370 calculates the distance from the auto-correlation of the weighted codevector calculated in the weighted auto-correlation calculation circuit 460 and the cross-correlation of the weighted codevector and the weighted input signal vector calculated in the weighted cross-correlation calculation circuit 365 by using the equation (8). The distance inspection circuit 375 delivers the index of the codevector corresponding to the minimum calculated distance to the output terminal 380. Further, it supplies output command flags to the signal codebook circuit 335 and the auto-correlation codebook circuits 340 and 345 such that these circuits supply the next codevector, auto-correlations and cross-correlation.

What is claimed is:

1. A speech coder for coding speech signals, said speech coder including a vector quantizer, said vector quantizer comprising:

a plurality of auto-correlation calculation means each of which calculates an auto-correlation of an impulse response signal of a weighting function for a corresponding sub-interval of a plurality of sub-intervals of an input signal vector which corresponds to the input speech signal;

a signal codebook means for storing a plurality of codevectors produced in advance, each of said codevectors having a length equal to a code length of said input signal vector;

a plurality of auto-correlation codebook means for respectively storing a corresponding one of the plurality of auto-correlations calculated by a corresponding one of said plurality of auto-correlation calculation means;

a first auto-correlation calculation circuit for calculating an auto-correlation of a first impulse response signal, said first impulse response signal corresponding to a weighting function for a first time interval of an input signal vector which corresponds to the input speech signal;

a second auto-correlation calculation circuit for calculating an auto-correlation of a second impulse response signal, said second impulse response signal corresponding to said weighting function for a second time interval of said input signal vector, wherein said second time interval has a same time length as said first time interval and wherein said second time interval starts immediately after said first time interval ends;

a signal codebook for storing a plurality of codevectors, each of said codevectors having a length equal to a code length of said input signal vector;

a first auto-correlation codebook for storing the auto-correlation of the first impulse response signal as calculated by said first auto-correlation calculation circuit;

a second auto-correlation codebook for storing the auto-correlation of the second impulse response signal as calculated by said second auto-correlation calculation circuit;

a cross-correlation codebook for storing a cross-correlation of the first and second sub-intervals for each of the codevectors;

a weighted cross-correlation calculation circuit for calculating a weighted cross-correlation of the input signal vector and each of the codevectors, with both the input signal vector and said each codevector being weighted by the weighting function, the weighted cross-correlation being performed for each codevector with respect to the input signal vector, the auto-correlations of the first and second impulse response signals, and the cross-correlation for said each codevector that is stored in the cross-correlation codebook;

a weighted auto-correlation calculation circuit for calculating a weighted auto-correlation for said each codevector, a cross-correlation codebook means for storing a plurality of cross-correlations of the respective sub-intervals for each of the codevectors;

a weighted cross-correlation calculation means for calculating a weighted cross-correlation of the input signal vector and each of the codevectors by weighting the input signal vector and said each codevector by the weighting function corresponding to each of the sub-intervals, and calculating the weighted cross-correlation by using the input signal vector, the plurality of codevectors and the plurality of impulse response signals;

a weighted auto-correlation calculation means for calculating an auto-correlation of each of the weighted codevectors, as a weighted auto-correlation, by using the auto-correlations of the plurality of impulse response signals, the plurality of codevectors, and the cross-correlations;

a distance calculation means for calculating a corresponding distance between the input signal vector and each of the codevectors, by using the cross-correlations of the weighted input signal vector and weighted codevectors, and the auto-correlation of the weighted codevectors; and a distance inspection means for supplying an index of one of the codevectors corresponding to a minimum distance of the distances calculated by the distance calculation means, wherein the one of the codevectors is used to quantize the input speech vector.

2. A speech coder for coding speech signals said speech coder including a vector quantizer, said vector quantizer comprising:

a plurality of auto-correlation calculation means each of which calculates an auto-correlation of an impulse response signal of a weighting function for a corresponding sub-interval of a plurality of sub-intervals of an input signal vector which corresponds to the input speech signal;

a signal codebook means for storing a plurality of codevectors produced in advance, each of said codevectors having a length equal to a code length of said input signal vector;

a plurality of auto-correlation codebook means for respectively storing a corresponding one of the plurality of auto-correlations calculated by a corresponding one of said plurality of auto-correlation calculation means;

a weighted cross-correlation calculation means for calculating a weighted cross-correlation of the input signal vector and each of the codevectors by weighting the input signal vector and said each codevector by the weighting function corresponding to each of the sub-intervals, the weighted cross-correlation being calculated by using the input signal vector, the plurality of codevectors and the plurality of impulse response signals;

a weighted auto-correlation calculation means for calculating an auto-correlation of each of the weighted codevectors, as a weighted auto-correlation, by using the auto-correlations of the plurality of impulse response signals and the plurality of codevectors;

a distance calculation means for calculating a corresponding distance between the input signal vector and each of the codevectors, by using the cross-correlations of the weighted input signal vector and weighted codevectors, and the auto-correlation of the weighted codevectors; and a distance inspection means for supplying an index of one of the codevectors corresponding to a minimum distance of the distances calculated by the distance calculation means, wherein the one of the codevectors is used to quantize the input speech signal.

3. A speech coder for coding speech signals, said speech coder including a vector quantizer, said vector quantizer comprising: the weighted auto-correlation for said each codevector being weighted by the weighting function, the weighted auto-correlations being calculated using the auto-correlations of the first and second impulse response signals respectively retrieved from the first and second auto-correlation codebooks, together with the cross-correlations retrieved from the cross-correlation codebook;

a distance calculating circuit for calculating a distance for said each codevector with respect to the input signal vector, the corresponding distance being calculated by using the weighted cross-correlations of said codevector and the weighted auto-correlations of said each codevector; and a distance inspection circuit for supplying an index of a particular one of the codevectors which has a minimum distance among the distances calculated by the distance calculating circuit, wherein the particular one of the codevectors is used to quantizer the input speech signal.

4. A vector quantizer according to claim 3, wherein the distance inspection circuit outputs an output command flag to each of the signal codebook, the first auto-correlation codebook, the second auto-correlation codebook, and the cross-correlation codebook, wherein the output command flag is used by the signal codebook to output one of the codevectors stored therein together with a first index designation, with one of the codevectors being output for every receipt of the output command flag, wherein an index number for the signal codebook is incremented by one for every receipt of the output command flag;

wherein the output command flag is used by the first and second auto-correlation codebooks to respectively output the auto-correlation of one of the first impulse response signal and the second impulse response signal that are stored therein together with a second index designation, wherein an index number for the respective first and second auto-correlation codebooks is incremented by one for every receipt of the output command flag, and wherein the output command flag is used by the cross-correlation codebook to output the cross-correlations stored therein together with a third index designation, wherein an index number for the cross-correlation codebook is incremented by one for every receipt of the output command flag.

5. A vector quantizer according to claim 4, wherein the first, second and third index designation are identical, such that information related to a particular one of the codevectors is output substantially simultaneously from the signal codebook, the first auto-correlation codebook, the second auto-correlation codebook, and the cross-correlation codebook.

* * * * *